United States Patent [19]

Dragone

[11] 4,166,276

[45] Aug. 28, 1979

[54] OFFSET ANTENNA HAVING IMPROVED SYMMETRY IN THE RADIATION PATTERN

[75] Inventor: Corrado Dragone, Little Silver, N.J.

[73] Assignee: Bell Telephone Laboratories, Incorporated, Murray Hill, N.J.

[21] Appl. No.: 857,528

[22] Filed: Dec. 5, 1977

[51] Int. Cl.[2] ..... H01Q 19/14

[52] U.S. Cl. ..... 343/781 P; 343/840; 343/837

[58] Field of Search ..... 343/781 P, 781 CA, 781, 343/775, 840, 837

[56] References Cited

U.S. PATENT DOCUMENTS 3,414,904 12/1968 Ajioka ..... 343/781 CA

*Primary Examiner*—David K. Moore

*Attorney, Agent, or Firm*—Erwin W. Pfeifle

[57] ABSTRACT

The present invention relates to an antenna system for providing substantially perfect axial symmetry in the radiation pattern which combines (a) a curved main reflector, (b) at least two confocal subreflectors disposed to sequentially reflect a ray in either direction between the main reflector and a focal point of the antenna system as provided by the subreflector most distant along the feed axis from the main reflector, and (c) a symmetrical feedhorn disposed at the focal point of the antenna system so that its longitudinal axis coincides with the equivalent axis of the antenna system.

2 Claims, 10 Drawing Figures

OFFSET ANTENNA HAVING IMPROVED SYMMETRY IN THE RADIATION PATTERN

BACKGROUND OF THE INVENTION

1. Field of the Invention

The present invention relates to an offset antenna system which provides improved symmetry in the radiation pattern over prior art antennas and, more particularly, to an offset antenna system comprising a curved focusing main reflector, at least two conic subreflectors and a feedhorn where the combination of elements are oriented such that the feedhorn is disposed at the focal point of the combined reflectors in a manner to coincide with the equivalent axis of the antenna system.

2. Description of the Prior Art

The use of orthogonal polarizations is often required in radio systems to double the transmission capacity between two remote points. Orthogonal polarizations have been radiated by a circular corrugated wall feedhorn which produces a spherical wave having circular symmetry. By placing the feedhorn at the focus of a parabolic reflector, an antenna with circular symmetry in the far-field is obtained provided the paraboloid is centered around the feed axis. In such a configuration the feedhorn partially blocks the reflected wave. To avoid such partial blockage, the feedhorn axis has been offset which unfortunately has been found to cause asymmetry in the radiated pattern after reflection, resulting in undesirable cross-polarization components in the reflected waves. The same behavior occurs if, instead of a parabola, an arbitrary reflector system with a single axis of revolution is used. Generally, it has been found that the asymmetry of the reflected wave increases with the angle of incidence of the ray corresponding to the feedhorn axis.

Various arrangements have been disclosed for improving discrimination between two polarizations transmitted by an offset antenna. One such arrangement is disclosed in U.S. Pat. No. 4,024,543 issued to V. J. Vokurka on May 17, 1977 which relates to a parabolic antenna comprising a number of parabolic cylinder surfaces as reflectors mounted confocally with a common plane of symmetry, and a feedhorn whose plane is substantially perpendicular to the planes of symmetry of the reflectors next to the radiator in the path of the rays. The Vokurka antenna provides a low cross-polarization value by including more than two substantially parabolic surfaces with each pair of surfaces having in common one line focus and one plane of symmetry, the line-foci intersecting or crossing each other.

Although a reflection from an offset surface causes some asymmetry, it is known to combine two reflections with nonzero angles of incidence so as to insure substantially improved symmetry after two reflections. In this regard see, for example, the article "Elimination of Cross Polarization in Offset Dual-Reflector Antennas" by H. Tanaka et al in *Electronics and Communication in Japan*, Vol. 58-B, No. 12, 1975 at pp. 71–78 which relates to the optogeometrical condition for effective cancellation of the cross polarization in an offset dual-reflector antenna comprising a paraboloidal main reflector, a subreflector having a shape which is a quadratic surface of resolution and a feedhorn. Cross polarization cancellation is effected dependent on the types, whether concave or convex, and the eccentricity of the subreflector, and the angles of the axes of the main reflector, subreflector and feedhorn. Additionally, see for instance, U.S. Pat. No. 3,792,480 issued to R. G. Graham on Feb. 12, 1974 which discloses an antenna system comprising a feedhorn, a subreflector and a main reflector where the feedhorn is displaced from the axis of the main reflector, and the axis of the subreflector is transverse to the axis of the main reflector to reduce certain asymmetrics.

Although the prior art arrangements provide substantially improved cross-polarization discrimination, the problem remaining is to provide a reflector antenna system comprising three or more reflectors with perfect symmetry in the radiation pattern where perfect symmetry implies perfect performance in cross-polarization discrimination.

SUMMARY OF THE INVENTION

The above-mentioned problem has been solved in accordance with the present invention which relates to an offset antenna system comprising a curved focusing main reflector, at least two conic subreflectors and a feedhorn, the combination of these elements being oriented such that the feedhorn is disposed at the focal point of the combined confocal reflectors and in a manner to coincide with the equivalent axis of the antenna system.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

In accordance with the present invention, perfect performance in cross-polarization discrimination and elimination of astigmatism to a first order approximation is achieved in an antenna system by disposing a symmetrical feedhorn at the focal point of the antenna system such that the longitudinal axis of the feedhorn coincides with the equivalent axis of the antenna system. The description which follows is intended to provide the necessary background and explanation for the various arrangements of antenna elements to achieve perfect cross-polarization discrimination in the far-field of the antenna.

Figure 1:
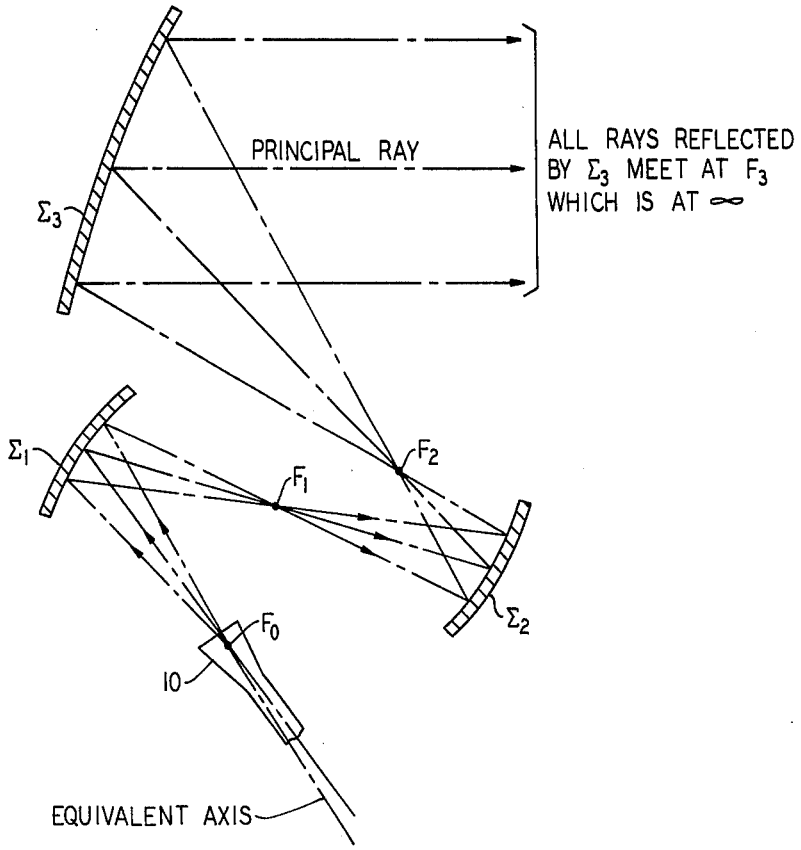
FIG. 1 (PRIOR ART)
FIG. 1 is a typical prior art antenna system where a spherical wave from a focal point $F_0$ is transformed into a plane wave by three confocal reflectors.

In FIG. 1 a typical antenna system is shown comprising a feedhorn 10 disposed at a focal point $F_0$ of the antenna system and three reflectors designated $\Sigma_1$ to $\Sigma_3$ to produce a spherical wave after each reflection which passes through focal points $F_1$ to $F_3$, respectively. Thus, in general, if $F_N$ is the focal point after the $N^{th}$ reflection, the $N^{th}$ reflector $\Sigma_N$ transforms a spherical wave centered at the focal point $F_{N-1}$, into a spherical wave centered at focal point $F_N$. It is to be understood that any of the focal points $F_0$ to $F_N$ may be at $\infty$, in which case the corresponding spherical waves become plane waves. This condition is shown in FIG. 1 by placing $F_3$ at $\infty$ which requires reflector $\Sigma_3$ to be a paraboloid.

It can be demonstrated that a sequence of confocal reflectors as shown, for example, in FIG. 1 always has an equivalent single reflector which will be either an ellipsoid, hyperboloid or paraboloid. This equivalent reflector produces, after a single reflection the same reflected wave pattern as was produced by the given sequence of reflectors. This means that the field distribution over a wavefront reflected by the equivalent single reflector will coincide with the field distribution over the corresponding wavefront produced by the given sequence of reflectors. It is to be understood that such equivalent single reflector does not of necessity coincide with the location of any one of the given sequence of reflectors or that the direction of the wavefront produced by the single equivalent reflector has to correspond to the direction of the wavefront produced by the given sequence of reflectors. The only correlation between the single equivalent reflector and the given sequence of reflectors is that the field distribution over the wavefront produced by each of the arrangements are the same.

In accordance with the foregoing explanation, for purposes of determining the properties of the reflected wave, it is possible to replace the N confocal reflectors of FIG. 1 with an equivalent reflector (not shown). The equivalent reflector has an axis of revolution which passes through focal point $F_0$ and will hereinafter be referred to as the "equivalent axis." The equivalent axis for the three reflectors of FIG. 1 may, for example, be in the direction shown in FIG. 1. How the equivalent axis is determined will be more clearly shown hereinafter. It is to be understood that in order for the symmetry of the incident beam to be preserved, the principal ray must coincide with the equivalent axis, where the principal ray is that ray which corresponds to the longitudinal axis of the feedhorn disposed at focal point $F_0$. Since, in theory, it is possible to travel along the equivalent axis in two opposite directions, two opposite orientations can be chosen for the principal ray. Suffice it to say, that for symmetry to be preserved, and in turn to eliminate cross-polarization components in the wavefront reflected by reflector $\Sigma_3$ in FIG. 1, feedhorn 10 should be reoriented to have its longitudinal axis coincide with the equivalent axis.

Figure 2:
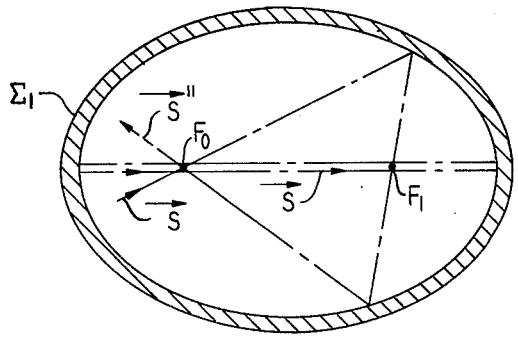
FIG. 2 (PRIOR ART)
FIG. 2 is a diagram of a method of determining the equivalent axis of a reflector via a reflected ray emanating from a foci of the reflector.

For a clear understanding of the definition and derivation of the equivalent axis, the single reflector $\Sigma_1$ as shown in FIG. 2 will be considered. If the reflector $\Sigma_1$ and one of its foci, $F_0$, are known, but the exact location of the axis of $\Sigma_1$ is not known and must be found, then the following procedure may be used. A ray emanating from foci $F_0$ is reflected twice by $\Sigma_1$ as shown in FIG. 2 where the construction of the complete reflector $\Sigma_1$ is also shown. Where $\vec{s}$ and $\vec{s}''$ are the initial and final direction of the ray, respectively, after two reflections by $\Sigma_1$, then it can be seen that $\vec{s}$ will only equal $\vec{s}''$ when the ray coincides with the axis of the reflector. Therefore, by searching for a ray which satisfies this condition, the axis of the reflector can be found. As can also be seen from FIG. 2, two such rays can satisfy the condition where $\vec{s}=\vec{s}''$, the one shown in the Figure and the one which emanates from $F_0$ in a direction opposite to that shown in FIG. 2 for the axial ray.

Figure 3:
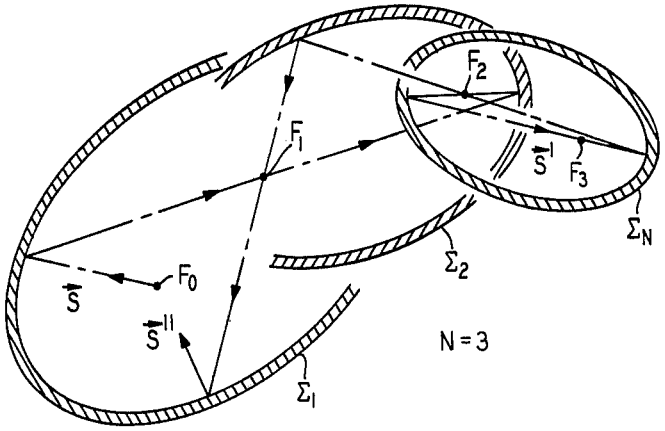
FIGS. 3 and 4 illustrate the method of FIG. 2 extended to determine the equivalent axis of a confocal sequence of N reflectors.
Figure 4:
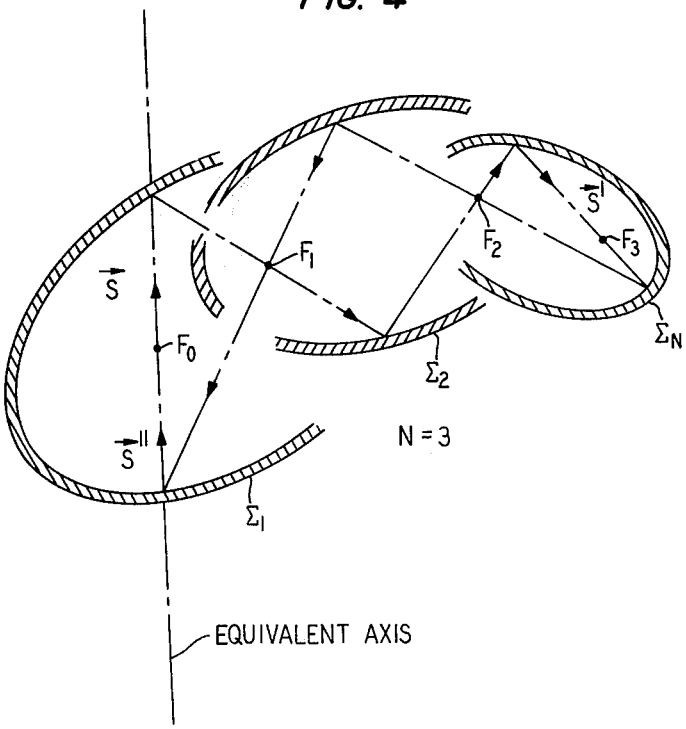

The previous description can also be extended to determine the equivalent axis for a confocal sequence of reflectors $\Sigma_1$ to $\Sigma_N$ as shown in FIGS. 3 and 4 where $N=3$. This is possible since, as was stated previously, a confocal sequence of reflectors has an equivalent single reflector. Thus, to determine the equivalent axis of a confocal sequence of reflectors, a ray from focal point $F_0$ with a direction $\vec{s}$ must be reflected twice by each of the reflectors $\Sigma_1$ to $\Sigma_N$ such that $\vec{s}=\vec{s}''$. The two reflections at each reflector indicates a total of 2 N reflections in the original configuration and the first N reflections occur in the order $\Sigma_1, \ldots, \Sigma_N$ while the last N reflections have the reverse order. The final ray has a direction $\vec{s}''$ which is the same direction $\vec{s}$ as the original ray when the original ray was launched coincident with the equivalent axis of the confocal sequence of reflectors. As shown in FIG. 3, $\vec{s}$ does not equal $\vec{s}''$ whereas in FIG. 4 $\vec{s}=\vec{s}''$ and, therefore, the ray through focal point $F_0$ gives the correct orientation of the equivalent axis and, in turn, the direction of the principal ray for which symmetry is preserved.

It is to be noted that the ray in FIG. 3 after the 2 N reflections will be reflected 2 N more times but will not follow the same path as the first 2 N reflections. On the other hand, the path of the ray in FIG. 4 is closed after 2 N reflections and will retrace the original path during each subsequent 2 N reflections. This closed path, which determines the equivalent axis, will hereinafter be referred to as the "central path" and the two rays which proceed along the central path in opposite senses will be referred to as "central rays."

Figure 5:
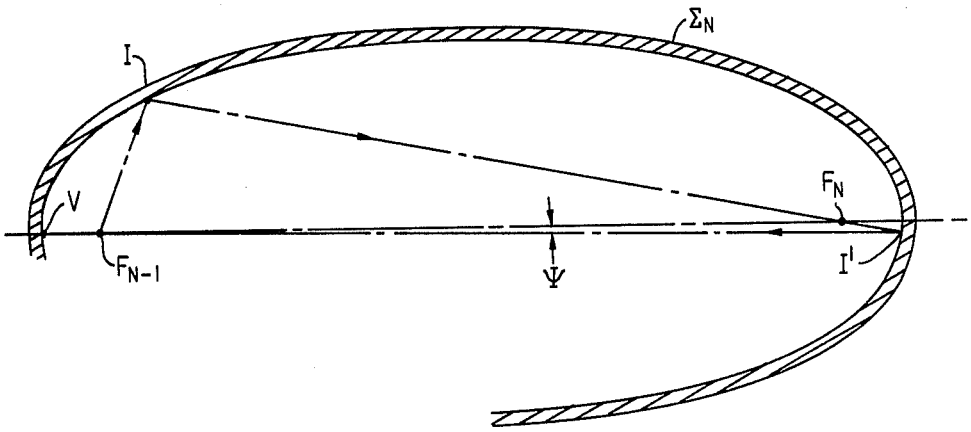
FIG. 5 illustrates the concept that with a paraboloid reflector the direction of the ray after two reflections is independent of the initial direction and coincides with the paraboloid axis.

The condition that $\vec{s}=\vec{s}''$ leads to a straightforward geometrical procedure for determining the equivalent axis when the $\Sigma_N$ reflector is a paraboloid. In FIG. 5 it is shown that when the last reflector $\Sigma_N$ is replaced by a concave paraboloid reflector in, for example, FIGS. 3 and 4, the final ray direction after two reflections therefrom becomes independent of the initial direction towards the first reflection therefrom. More particularly, in FIG. 5, the parameters of the ellipsoid $\Sigma_N$ of FIGS. 3 and 4 are modified by keeping the vertex V and the focus $F_{N-1}$ fixed and then increasing the distance between $F_N$ and $F_{N-1}$ until $F_N$ approaches infinity. The ellipsoid then becomes a paraboloid with a focus $F_{N-1}$ and it can be seen from FIG. 5 that the angle $\phi$ is effectively equal to zero degrees, where $\phi$ is the angle between the axis of $\Sigma_N$ and the ray produced after the second reflection. Therefore, the final ray after the second reflection coincides with the paraboloid axis and has a direction going from focus $F_{N-1}$ towards the vertex V of the paraboloid $\Sigma_N$.

Figure 6:
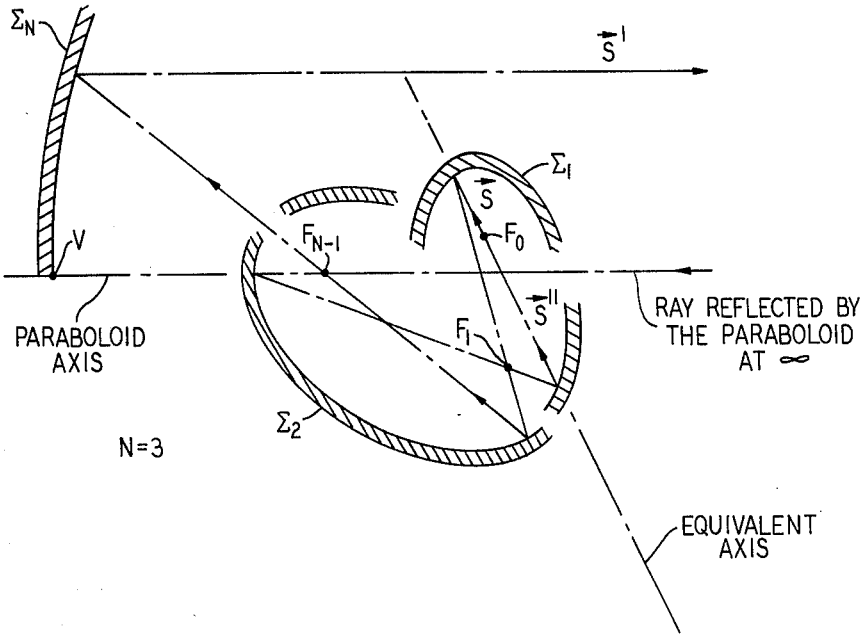
FIG. 6 illustrates a simple method for determining the equivalent axis of a sequence of N confocal reflectors where the last reflector, $\Sigma_N$, is a paraboloid.

FIG. 6, as with FIGS. 3 and 4, illustrates an antenna system including three confocal reflector surfaces $\Sigma_1$ to $\Sigma_N$, where $N=3$ and the last reflector $\Sigma_N$ is a paraboloid. From the discussion of FIG. 5, when the last reflector is a paraboloid, as in FIG. 6, the second reflection therefrom returns coincident with the axis of the paraboloid to continue the last N reflections via reflectors $\Sigma_2$ and $\Sigma_1$. The direction $\vec{s}''$ so obtained at focal point $F_0$ gives the equivalent axis of the antenna system. From FIG. 6 it can be seen that the direction $\vec{s}''$ so obtained is coincident with the equivalent axis of the antenna system since a ray with the initial direction $\vec{s}$ given by the above value of $\vec{s}''$ will always close after 2 N reflections. Therefore, the equivalent axis of a sequence of N-1 confocal reflectors $\Sigma_1$ to $\Sigma_{N-1}$ followed by a paraboloid $\Sigma_N$ with a focus $F_{N-1}$ and a vertex V can be determined simply by reflecting N−1 times the ray returning through $F_{N-1}$ towards the vetex V by reflectors $\Sigma_{N-1}$ to $\Sigma_1$. The final ray through focal point $F_0$ is the equivalent axis of the sequence of confocal reflectors and the direction which a feedhorn should be disposed to have perfect symmetry in the aperture of the sequence of the confocal reflectors $\Sigma_1$ to $\Sigma_N$.

Figure 7:
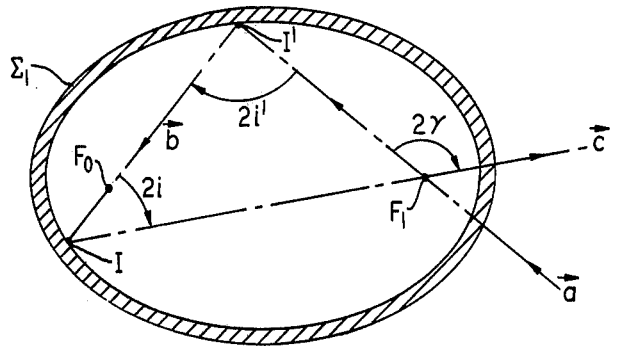
FIG. 7 illustrates two successive reflections by a concave ellipsoid reflector for determining the relationship governing such reflections.

Beam symmetry can be easily accomplished after an arbitrary number of reflections by adding a first or last reflector satisfying a predetermined condition. To understand this predetermined condition, the relationship governing the reflections of a central ray by the first or the last reflector must be clarified. For this discussion it must be understood that the restriction that the last reflector $\Sigma_N$ must be a paraboloid is removed. The closed path of the central ray in FIGS. 3 and 4 involves two successive reflections by reflector $\Sigma_1$. Consider these two reflections and assume for the moment that reflector $\Sigma_1$ is a concave ellipsoid as shown in FIG. 7. The central ray in FIG. 7 first passes through focal point $F_1$ with direction $\vec{a}$, is successively reflected at incident points I′ and I, and then passes again through focal point $F_1$ with direction $\vec{c}$.

In FIG. 7, $2i$ and $2i'$ are the angles of the two reflections and, M and M′, the corresponding magnifications, can be determined by $$M=\pm(l_1/l_2),\ M'=\pm(l'_1/l'_2), \tag{1}$$

where $l_1$, $l_2$, $l'_1$ and $l'_2$ are defined as $$|IF_0|=l_1,\ |IF_1|=l_2$$

$$|I'F_0|=l'_2\ |I'F_1|=l'_1. \tag{2}$$

Figure 10:
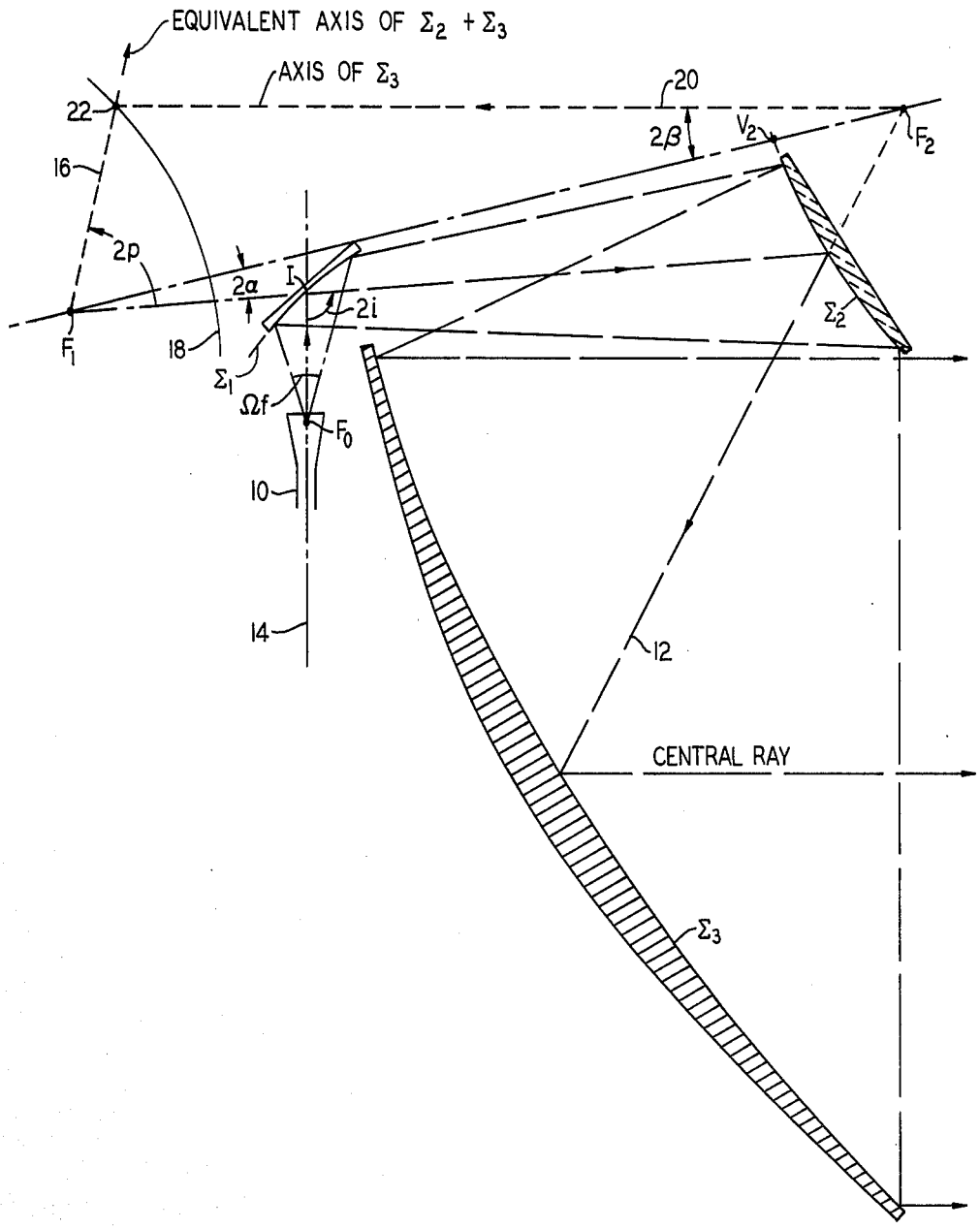
FIG. 10 illustrates a typical three reflector antenna system with improved symmetry at the aperture thereof in accordance with the present invention.

In Equation (1) it is to be understood that a positive sign is to be used when the focal points $F_0$ and $F_1$ are on opposite sides of the tangent plane of I, as for example in the arrangement of FIG. 10, otherwise, as in FIG. 7 when both $F_0$ and $F_1$ are on the same side of the tangent plane of I, a negative sign is to be used and $M<0$.

Then, if $2\gamma=2i+2i'$ and is the total angle of reflection given by the angle between the final and initial rays $\vec{c}$ and $\vec{a}$, it can be shown that $$\tan i=M/(M-1)\tan\gamma \tag{3}$$

and $$\tan i'=1/(1-M')\tan\gamma. \tag{4}$$

Thus, if the parameters M, i, or M′, i′ of either reflection are given, the total angle of reflection, $\gamma$, for a central ray can be calculated. It is to be understood that Equations (3) and (4) apply also to the two consecutive reflections of the central ray by the last reflector $\Sigma_N$. In FIG. 7 the reflector $\Sigma_1$ is shown as a concave ellipsoid, but Equations (3) and (4) are valid also if $\Sigma_1$ is a hyperboloid, or is convex.

From the discussion relating to FIG. 7, it can next be shown that when an arbitrary number of N−1 reflections, by a sequence of N−1 confocal reflectors $\Sigma_1$ to $\Sigma_{N-1}$ have distorted the initial symmetry of a spherical wave originating from, for example, focal point $F_0$, beam symmetry can easily be restored by the introduction of an additional reflector $\Sigma_N$ to place the feedhorn coincident with the equivalent axis. To illustrate this technique, in FIG. 8 a principal ray 12 through focal point $F_0$ is reflected N−1 times, where N=3, by reflectors $\Sigma_1$ and $\Sigma_2$ and is assumed to have its initial symmetry distorted. The reflector, $\Sigma_N$, to be added must be chosen so that the principal ray 12 also becomes one of the two central rays in the sequence of reflections by reflectors $\Sigma_1$ to $\Sigma_N$. This requires that the path of ray 12 must close after 2 N successive reflections, as has been explained previously in the discussions of FIGS. 3 and 4.

Figure 8:
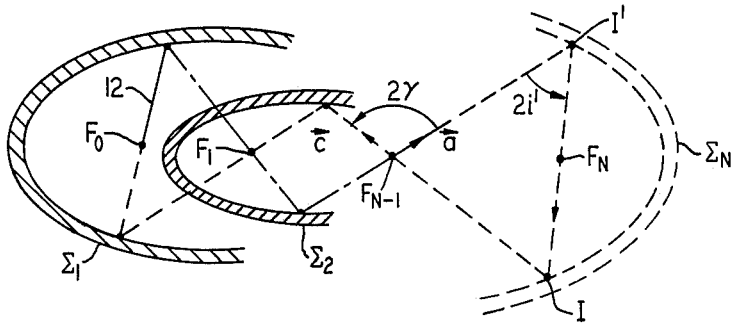
FIGS. 8 and 9 illustrate a three reflector antenna system for determining the condition for the last and the first reflector, respectively, for restoring symmetry after two reflections.

Since reflectors $\Sigma_1$ and $\Sigma_2$ are fixed, the path of principal ray 12 from focal point $F_0$ and the reflections from reflectors $\Sigma_1$ and $\Sigma_2$ are also fixed in advance. Since ray 12 must also be one of the two central rays after 2 N reflections, ray 12 can next be extended in the appropriate direction and also reflected by reflectors $\Sigma_1$ and $\Sigma_2$, as shown by the dotted line in FIG. 8. Therefore, the fixed path thus far determined for the 2 N−1 reflections starts at focal point $F_{N-1}$ with an initial direction $\vec{c}$ and after 2 N−1 reflections ends again at focal point $F_{N-1}$ with a direction $\vec{a}$. Since the final direction $\vec{a}$ is given and the initial direction c can easily be found by tracing ray 12 backwards, the condition that reflector $\Sigma_N$ must satisfy to restore symmetry is simply determined using Equation (4), where the angle $\gamma$ is equal to one-half the angle between directions $\vec{c}$ and $\vec{a}$ as shown in FIG. 8.

Figure 9:
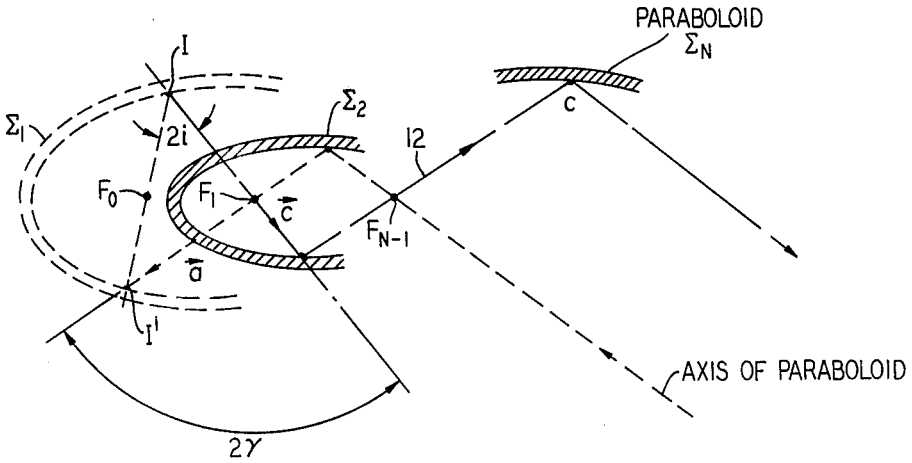

The foregoing technique for determining the condition for the last reflector $\Sigma_N$ similarly applies to the problem where the first reflector $\Sigma_1$ is to be added to restore symmetry and the remaining reflectors $\Sigma_2$ to $\Sigma_N$ are fixed. The only difference under such case is that Equation (3) must be applied instead of Equation (4). More particularly, where, for example, the last reflector $\Sigma_N$ is a paraboloid, as shown in FIG. 9, for N=3, and all the reflectors except the first reflector $\Sigma_1$ are given, first reflector $\Sigma_1$ must be chosen such that the principal ray 12 incident or paraboloid $\Sigma_N$ is also the central ray. In FIG. 9, the path of ray 12 starting at focal point $F_1$ with an initial direction $\vec{c}$ and reflected by reflectors $\Sigma_2$ and $\Sigma_N$ is fixed. It was shown hereinbefore that the ray returning from the second reflection of paraboloid $\Sigma_N$ at $\infty$ is along the axis of the paraboloid and, therefore, the path, shown dotted in FIG. 9, of this returning ray which is reflected by reflector $\Sigma_2$ through focal point $F_1$ with a final direction a is also easily determined. Once direction $\vec{a}$ is determined from ray tracing, the condition that reflector $\Sigma_1$ must satisfy to restore beam symmetry is given by Equation (3).

A typical antenna system having good polarization discrimination and arranged in accordance with the present invention is shown in FIG. 10. It is to be understood that this arrangement is shown for purposes of illustration and not for purposes of limitation. It will be readily appreciated that the inventive concept described hereinbefore is equally applicable to other arrangements and combinations of confocal reflectors. In the typical antenna system shown in FIG. 10, a large parabolic reflector $\Sigma_3$ and two smaller hyperboloid reflectors $\Sigma_2$ and $\Sigma_1$ are disposed to bidirectionally direct a central ray 12 between the aperture of the antenna system and a focal point $F_0$ with the ray's longitudinal axis coincident with the equivalent axis 14 of the combination of reflectors $\Sigma_1$ to $\Sigma_3$.

To achieve good polarization discrimination, the angle of incidence i and the magnification M of the first reflector $\Sigma_1$ must satisfy the condition $$\tan i = M/(1-M) \tan p \quad (5)$$

with p given by the angle shown in FIG. 10 and M being a positive value since focal points $F_0$ and $F_1$ are on opposite sides of the tangent plane of I in the arrangement of FIG. 10. To understand the significance of the angle p, the last two reflectors $\Sigma_2$ and $\Sigma_3$ are replaced by their equivalent paraboloid reflector (not shown). The axis 16 of the equivalent paraboloid is obtainable as shown in FIG. 10 by reflecting the axis 20 of reflector $\Sigma_3$ from focal point $F_2$ once onto reflector $\Sigma_2$. Since reflector $\Sigma_2$ is a hyperboloid under the exemplary arrangement of FIG. 10, the reflection occurs from the other portion 18 of the hyperboloid of reflector $\Sigma_2$ since focal point $F_2$ is on the opposite side of the reflector $\Sigma_2$. The equivalent axis of reflectors $\Sigma_2$ plus $\Sigma_3$ is the projection from focal point $F_1$ through the point of incidence 22 of the axis 20 of reflector $\Sigma_3$ onto hyperboloid 18. The angle $2p$ then is the angle that the central ray 12 projected through focal point $F_1$ makes with the equivalent axis 16 of reflectors $\Sigma_2$ plus $\Sigma_3$ which is to be used in Equation (5).

It is to be understood that the above-described embodiments are simply illustrative of the principles of the invention. Various other modifications and changes may be made by those skilled in the art which will embody the principles of the invention and fall within the spirit and scope thereof.

What is claimed is:

1. An antenna system comprising a plurality of N sequentially confocal reflectors having N+1 separate focal points comprising at least a curved focusing offset main reflector capable of bidirectionally reflecting a beam of radiated energy between the $N^{th}$ and the N+1 focal points along the feed axis thereof, a first subreflector disposed along the feed axis of the main reflector comprising a conic reflecting surface capable of bidirectionally reflecting said beam of radiated energy between said main reflector and an N−1 focal point of the N+1 separate focal points; and a second subreflector disposed along the feed axis of said main reflector and first subreflector comprising a conic reflecting surface capable of bidirectionally reflecting said beam of radiated energy between said first subreflector and an N−2 focal point of the N+1 separate focal points; and a symmetrical feedhorn disposed at a first focal point of said N+1 focal points and oriented with the longitudinal axis thereof coincident with an equivalent axis of the plurality of N sequentially confocal reflectors, the equivalent axis being the axis of revolution which passes through the first focal point of an equivalent reflecting surface which is capable of producing after a single reflection the same field distribution over the reflected wavefront as that of the plurality of N sequentially confocal reflectors.

2. An antenna system according to claim 1 wherein said main reflector comprises a paraboloid reflecting surface and the N+1 focal point is disposed at infinity.

* * * * *